US007628602B2

(12) United States Patent
Matsuda

(10) Patent No.: US 7,628,602 B2
(45) Date of Patent: Dec. 8, 2009

(54) BRIQUETTE MANUFACTURING APPARATUS

(75) Inventor: Mitsuma Matsuda, Kagawa (JP)

(73) Assignee: JTEKT Corporation, Osaka (JP)

( * ) Notice: Subject to any disclaimer, the term of this patent is extended or adjusted under 35 U.S.C. 154(b) by 537 days.

(21) Appl. No.: 11/628,792

(22) PCT Filed: Jun. 8, 2005

(86) PCT No.: PCT/JP2005/010474

§ 371 (c)(1),
(2), (4) Date: Dec. 7, 2006

(87) PCT Pub. No.: WO2005/120818

PCT Pub. Date: Dec. 22, 2005

(65) Prior Publication Data

US 2008/0196605 A1 Aug. 21, 2008

(30) Foreign Application Priority Data

Jun. 9, 2004 (JP) ..... 2004-170664

(51) Int. Cl.
*B28B 13/00* (2006.01)
*B28B 3/02* (2006.01)

(52) U.S. Cl. ..... 425/256; 425/258; 425/355; 425/423

(58) Field of Classification Search ..... 425/219, 425/256, 258, 355, 423
See application file for complete search history.

(56) References Cited

U.S. PATENT DOCUMENTS 6,302,675 B1 * 10/2001 Lienau ..... 425/219
7,017,478 B2 * 3/2006 Nakamura et al. ..... 100/104
7,311,865 B2 * 12/2007 Williamson ..... 425/255

FOREIGN PATENT DOCUMENTS

| | | |
|---|---|---|
| FR | 2174389 | 10/1973 |
| JP | 10-211599 A | 8/1998 |
| JP | 2003-126994 A | 5/2003 |
| JP | 2003-326393 A | 11/2003 |
| JP | 2004-66290 A | 3/2004 |

* cited by examiner

*Primary Examiner*—Yogendra Gupta
*Assistant Examiner*—Thu Khanh T Nguyen
(74) *Attorney, Agent, or Firm*—Birch, Stewart, Kolasch & Birch, LLP

(57) ABSTRACT

A compression machine is provided which is adapted to improve the operation efficiency of the machine for achieving the reduction of plant and equipment costs per compact-product weight. A compression machine includes: a first cylinder body 1 constituting a compaction chamber for compacting a subject material S and is formed with an opening through which the subject material S is supplied; a pusher shaft 10 slidably disposed in the first cylinder body 1 and serving to compress and solidify the subject material S; driving means 40 for driving the pusher shaft 10; a second cylinder body 20 disposed in coaxial and tandem relation with the first cylinder body 1; and a pressure receiving member disposed in the second cylinder body 20 and having a pressure receiving surface opposing a distal end surface of the pusher shaft 10, the first cylinder body and the second cylinder body being allowed to move relative to each other in an axial direction.

20 Claims, 11 Drawing Sheets

BRIQUETTE MANUFACTURING APPARATUS

TECHNICAL FIELD

The present invention relates to a briquette manufacturing apparatus. More particularly, the invention relates to an apparatus for manufacturing the briquette by compressing and solidifying abrasive finishing sludge and the like occurring as a byproduct of a variety of abrasive finishing processes.

BACKGROUND ART

When a grinding apparatus including a variety of grinding machines is operated to machine a metal such as a ferrous metal, abrasive finishing sludge containing powdery cutting dust and the like is produced. The abrasive finishing sludge is a cumbersome industrial waste which is susceptible to oxidization, because the abrasive finishing sludge contains water, oil and iron and has a microscopic size. There is a demand for processing the sludge into the most possible compact form for recycling. It is therefore a general practice to compress the abrasive finishing sludge by means of a compression machine thereby forming a high-density solid mass. Such a compression machine generally includes: a cylinder body constituting a compaction chamber accommodating a subject material (abrasive finishing sludge); a pressurizing mechanism for pressurizing the subject material toward one end of the cylinder body; and a gate mechanism for opening/closing an aperture at one end of the cylinder body. The compression machine is designed to operate as follows. The abrasive finishing sludge supplied from a hopper disposed upwardly of the cylinder body is carried into the compaction chamber by means of a screw conveyor. The abrasive finishing sludge so delivered is compressed and solidified by means of a hydraulic cylinder constituting the pressurizing mechanism. Subsequently, the above aperture is opened by the gate mechanism, so that the solidified abrasive finishing sludge (briquette) is discharged out of the compaction chamber.

The gate mechanism of the above compression machine includes: a gate member pressed against an end surface at the one end of the cylinder body for closing the aperture of the cylinder body; and driving means for vertically moving the gate member between a first position to close the aperture and a second position to open the aperture. As constantly held in tight contact against the end surface of the cylinder body, the gate member is vertically moved between the first position and the second position.

In the compression of the abrasive finishing sludge in such a compression machine, the pressurizing mechanism applies a pressure in excess of 40 tons to the abrasive finishing sludge, so that the cylinder body constituting the compaction chamber may sometimes be subjected to a pressure in excess of 100 MPa. Therefore, when the gate member is raised, a great frictional force is applied between the solid mass and the gate member in contact with the solid mass due to a residual pressure caused by the spring back of the solid mass. Accordingly, a smooth movement of the gate member is impaired so that the malfunction of the gate member may result. As a solution to this problem, there has been disclosed a compression machine wherein the cylinder body constituting the compaction chamber has a dual structure including an inside and an outside cylinder body, and wherein the inside cylinder body is slightly retreated from the gate member so as to set the solid mass slightly apart from the gate member, whereby the frictional force applied between the solid mass and the gate member is reduced (refer to Japanese Unexamined Patent Publication No. 211599/1998).

DISCLOSURE OF THE INVENTION

Problem to be Solved by the Invention

However, the following problem is encountered by the compression machine of the above patent publication. The inside cylinder body is retreated so that an annular gap is formed between a pressure-contact surface of the gate member and the cylinder body. While the compacting operation is repeated, the abrasive finishing sludge is accumulated in the gap. The abrasive finishing sludge so accumulated in the gap obstructs the operation of opening/closing the gate member, thus dictating the need to clean the gap. This results in the decrease of operation efficiency. Hence, the above compression machine leaves room for improvement as the countermeasure against the residual pressure on the gate member.

In view of the above problem of the prior art, the invention has been accomplished and has an object to provide a compression machine which negates the need for the conventional operation of opening/closing the gate thereby to increase the operation efficiency of the machine for achieving the reduction of plant and equipment costs per compact-product weight.

Means for Solving the Problem

According to the invention, a briquette manufacturing apparatus includes: a first cylinder body constituting a compaction chamber for compacting a subject material and is formed with an opening through which the subject material is supplied; a pusher shaft slidably disposed in the first cylinder body and serving to compress and solidify the subject material; driving means for driving the pusher shaft; a second cylinder body disposed in coaxial and tandem relation with the first cylinder body; and a pressure receiving member disposed in the second cylinder body and having a pressure receiving surface opposing a distal end surface of the pusher shaft, and is characterized in that the first cylinder body and the second cylinder body are allowed to move relative to each other in an axial direction.

According to the briquette manufacturing apparatus of the invention, the first cylinder body and the second cylinder body constituting the compaction chamber are disposed in the coaxial and tandem relation and are allowed to move relative to each other in the axial direction. Hence, the apparatus is adapted to discharge the briquette from the compaction chamber without using the gate member required by the conventional apparatus. Specifically, after compressing and solidifying the subject material, the first cylinder body and the second cylinder body are moved relative to each other to define a gap therebetween, through which the briquette may be discharged. The omission of the gate member required by the conventional apparatus provides a solution to the problems of the decreased operation efficiency and the like, which result from the residual pressure on the gate member. The omission of the gate member also negates the need for the operation of opening/closing the gate mechanism for discharging the briquette, so that a cycle time to manufacture one product can be dramatically reduced (While the conventional apparatus takes a cycle time on the order of 25 seconds, a cycle time of the apparatus of the invention is 18 to 19 seconds, which is 5 to 6 seconds shorter than the above).

It is preferred that the pressure receiving member includes an ejector slidably disposed in the second cylinder body and allowed to retreat during a compacting operation of the subject material, and that the briquette manufacturing apparatus further includes a pushing mechanism for pushing the ejector toward the pusher shaft. In this case, a distal end surface of the pusher shaft, an inside wall of the second cylinder body and a distal end surface of the ejector can constitute the compaction chamber, wherein the briquette can be formed of the subject material such as the abrasive finishing sludge. The briquette so compacted in the second cylinder body by means of the pusher shaft can be automatically pushed out of the second cylinder body by means of the ejector coupled to the pushing mechanism.

The pushing mechanism may employ a resilient member disposed on an opposite side of the ejector from its side opposing the pusher shaft and serving to push the ejector toward the pusher shaft. In a case where the resilient member is used as the pushing mechanism, a power source for pushing out the briquette is not required. Hence, the apparatus can be simplified to achieve the reduction of plant and equipment costs.

It is preferred that the apparatus further includes engaging means for bringing the pusher shaft and the first cylinder body into engagement. The engaging means may include: a projection formed at the first cylinder body to project into the first cylinder body; and a recess formed in an outer periphery of the pusher shaft and having a size to allow at least a part of the projection to be fitted therein.

It is preferred that the apparatus further includes pushing means for pushing the first cylinder body toward the second cylinder body. The pushing means may include: a coil spring coiled about a rod extended in parallel to an axis of the first cylinder body; and an arm having one end thereof fixed to the first cylinder body and the other end thereof slidably mounted to the rod.

The provision of the engaging means and the pushing means permits the first cylinder body to be spaced away from the second cylinder body in conjunction with the motion of the pusher shaft and to be automatically returned to an original position after discharge of the briquette. Hence, the apparatus can be simplified by obviating a driving mechanism for the first cylinder body.

It is preferred that the driving means includes a ball screw mechanism for drivably moving the pusher shaft back and forth as converting a rotational motion of a motor into a linear motion. If the ball screw mechanism is used as the pressurizing mechanism, the pusher shaft can be moved faster than a case where the pusher shaft is moved by a hydraulic cylinder. This results in a further reduced cycle time.

BEST MODES FOR CARRYING OUT THE INVENTION

A briquette manufacturing apparatus according to the embodiment of the invention will be described in details as below with reference to the accompanying drawings.

Figure 1:
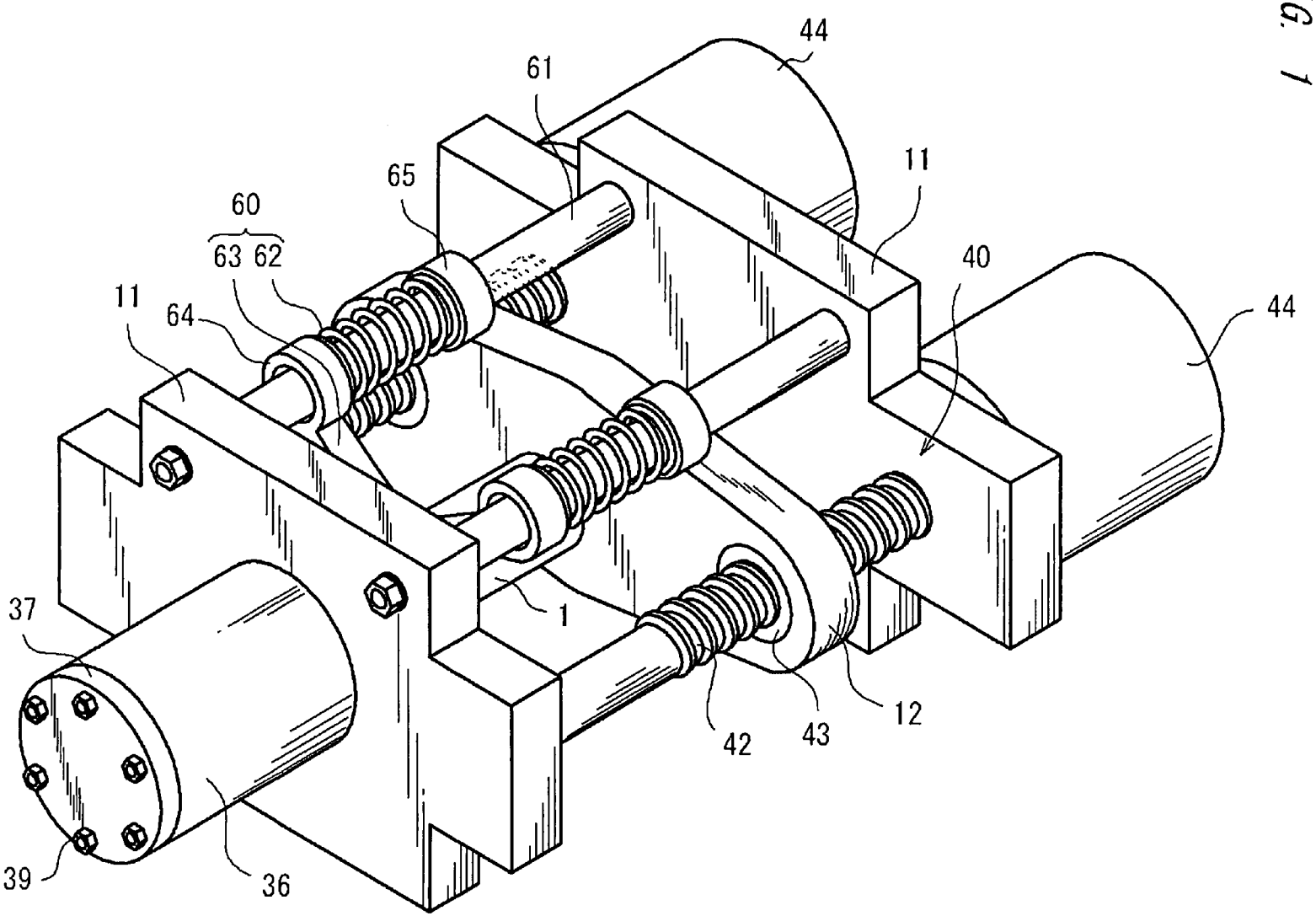
FIG. 1 is a perspective view illustrating a briquette manufacturing apparatus according to one embodiment of the invention.

FIG. 1 is a perspective view illustrating a briquette manufacturing apparatus according to one embodiment of the invention. As shown in the figure, the briquette manufacturing apparatus of the invention (hereinafter, simply referred to as the apparatus) includes: a first cylinder body 1 constituting a compaction chamber for compacting a subject material S (refer to FIG. 5) exemplified by a variety of powder metals such as abrasive finishing sludge, industrial sludges or the like; a pusher shaft 10 for compressing and solidifying the subject material S; and a ball screw mechanism 40 serving as driving means for driving the pusher shaft 10.

A peripheral wall of the first cylinder body 1 is formed with an opening (not shown) through which the subject material S fed into a hopper is supplied to the cylinder body, the hopper being disposed at an upper part of the apparatus. The subject material S is fed through the opening into the first cylinder body 1 by a predetermined quantity at a time, as carried on a screw conveyor or the like disposed under the hopper. Such a storage/metering delivery mechanism for the subject material S may employ those conventionally known in the art (such as one set forth in the above Patent Publication). The location of the opening is not limited to the peripheral wall of the cylinder body. The opening may be formed at any other place such as an end of the cylinder body.

The pusher shaft 10 is slidably disposed in the first cylinder body 1 and is fixed to a movable plate 12 interposed between a pair of fixed plates 11. While the pusher shaft 10 and the movable plate 12 according to the embodiment are formed in one piece, these components may also be formed separately and soldered to each other. A disk-like chip 13 conforming to an inside circumference of the first cylinder body 1 is attached to a distal end of the pusher shaft 10. This chip 13 is formed from a quench-hardened bearing steel such as SUJ-2. The chip slides on an inside surface of the first cylinder body 1 on its outer periphery when axially moved by the pusher shaft 10.

The ball screw mechanism 40 for driving the pusher shaft 10 includes: a pair of ball screws 42 assembled to the fixed plates 11 by means of bearings 41; ball nuts 43 assembled to the movable plate 12; and motors 44 having their output shafts fixed to the ball screws 42. The mechanism drivably moves the pusher shaft 10 back and forth as converting a rotational motion of the motor 44 into a linear motion. Specifically, when the motor 44 is driven into rotation, the ball screw 42 fixed to the output shaft of the motor 44 is rotated, thereby bringing the movable plate 12 into reciprocal movement. Thus, the pusher shaft 10 is advanced or retreated.

Figure 2:
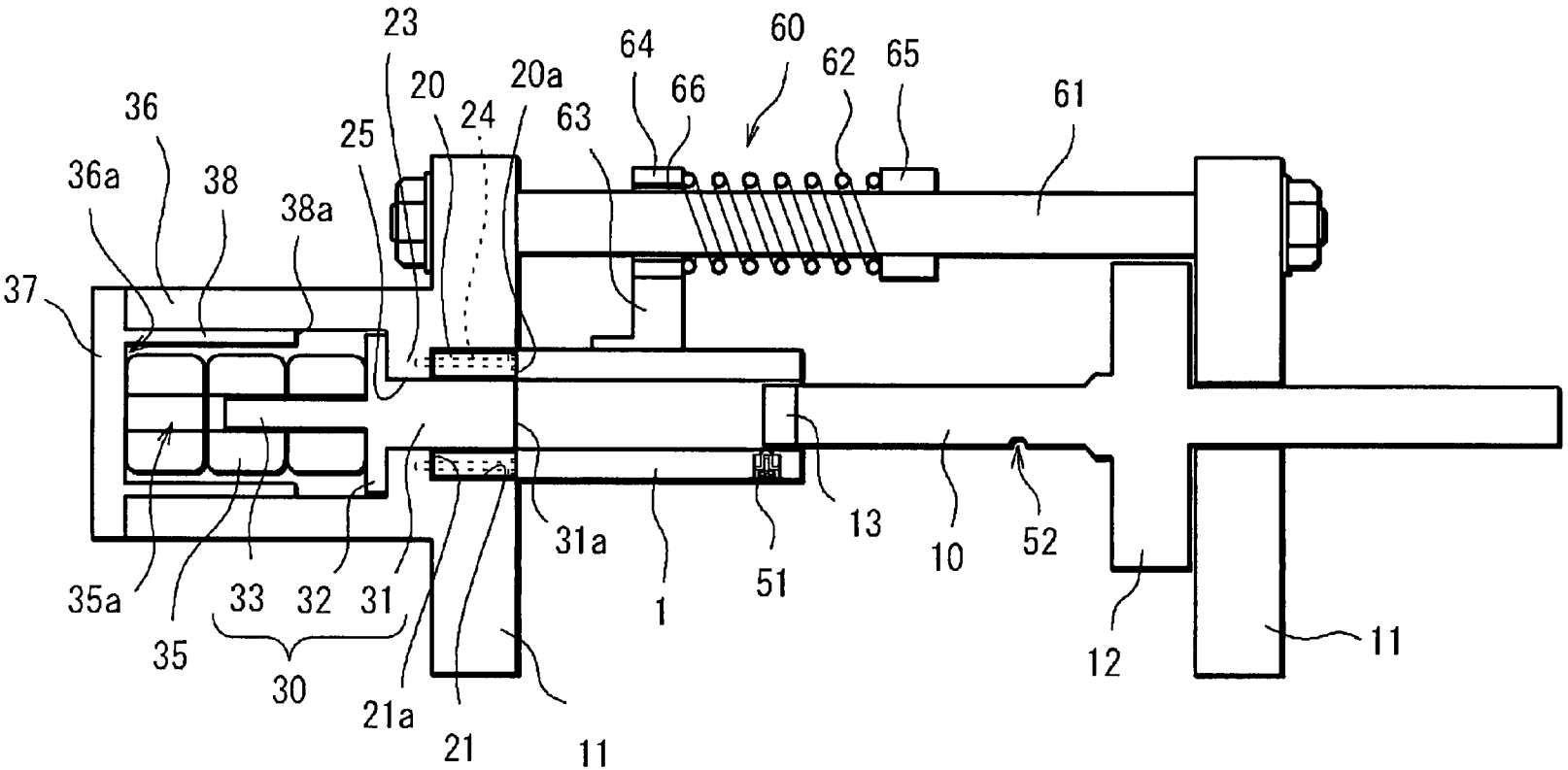
FIG. 2 is a side view illustrating the briquette manufacturing apparatus shown in FIG. 1.
Figure 3:
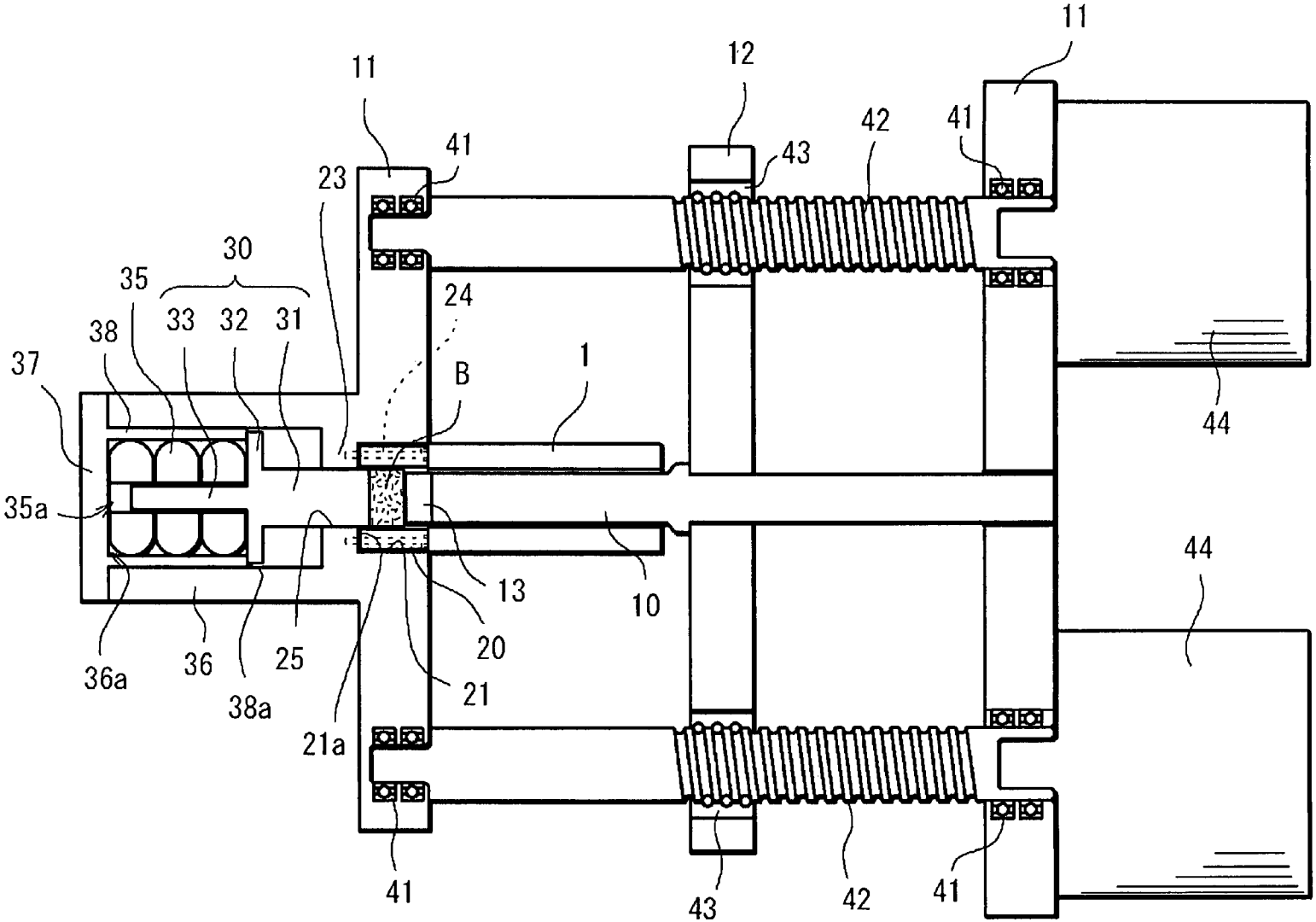
FIG. 3 is a plan view illustrating the briquette manufacturing apparatus shown in FIG. 1.

As shown in FIG. 2 and FIG. 3, the apparatus further includes: a second cylinder body 20 disposed in coaxial and tandem relation with the first cylinder body 1; an ejector 30 serving as a pressure receiving member slidably disposed in the second cylinder body 20 and having a pressure receiving surface opposing a distal end surface of the pusher shaft 10 (a distal end surface of the chip 13 at the distal end of the pusher shaft 10 (to be described hereinlater) according to the embodiment); and a resilient member 35 serving as a pushing mechanism disposed on an opposite side of the ejector 30 from its side opposing the pusher shaft 10 and pushing the ejector 30 toward the pusher shaft 10.

The second cylinder body 20 is disposed in a recess 21 formed in the fixed plate 11 and is fixed to an annular step 23 at the depth of the recess 21 by means of hexagon socket head bolts 24 or the like. The second cylinder body 20 is formed from a material having a great wear resistance such as a bearing steel including SUJ-2 and the like or a die steel including SKD-11 and the like, which is hardened to hardness on the order of HRC58 to 60 by heat treatment. Thus, the second cylinder body is adapted to withstand long term use. If the second cylinder body is worn or broken, the cylinder body can be readily replaced by removing the hexagon socket head bolts 24.

The second cylinder body 20 is disposed in coaxial and tandem relation with the first cylinder body 1 and has an inside diameter substantially equal to that of the first cylinder body 1. This permits the chip 13 at the distal end of the pusher shaft 10 to be smoothly moved from the first cylinder body 1 to the second cylinder body 20 or from the second cylinder body 20 to the first cylinder body 1. Furthermore, the first cylinder body 1 and the second cylinder body 20 are adapted to move relative to each other in an axial direction. When these cylinder bodies are moved relative to each other so as to be spaced away from each other, a gap can be formed therebetween. As will be described hereinlater, a briquette can be discharged through this gap.

The ejector 30 is retreatably disposed in the second cylinder body 20 and includes: a cylindrical column portion 31 having an outside diameter slightly smaller than the inside diameter of the second cylinder body 20; a disk-like stopper 32 formed at one end of the cylindrical column portion 31 (the end on an opposite side of the cylindrical column portion from its side opposing the pusher shaft 10); a guide shaft 33 projected from one side of the stopper 32 (the side opposite from the cylindrical column portion 31). According to the embodiment, the cylindrical column portion 31, the stopper 32 and the guide shaft 33 are formed in one piece. The cylindrical column portion 31 is slidably moved in the second cylinder body 20 as extended through a hole 25 defined by the step 23. An axial length of the cylindrical column portion 31 and a forming position of the stopper 32 are defined such that an end surface 31*a* of the cylindrical column portion 31 may become flush with an end surface 20*a* of the second cylinder body 20 when the cylindrical column portion 31 is moved to place closest to the pusher shaft 10 (FIG. 2). The ejector 30 may have any configuration that has a surface to pressurize the subject material S in cooperation with the pusher shaft 10 and is adapted to compress the resilient member 35. For instance, a closed-end cylinder body (disposed in the second cylinder body 20 in a manner to direct its bottom toward the pusher shaft 10) may be used.

Figure 6:
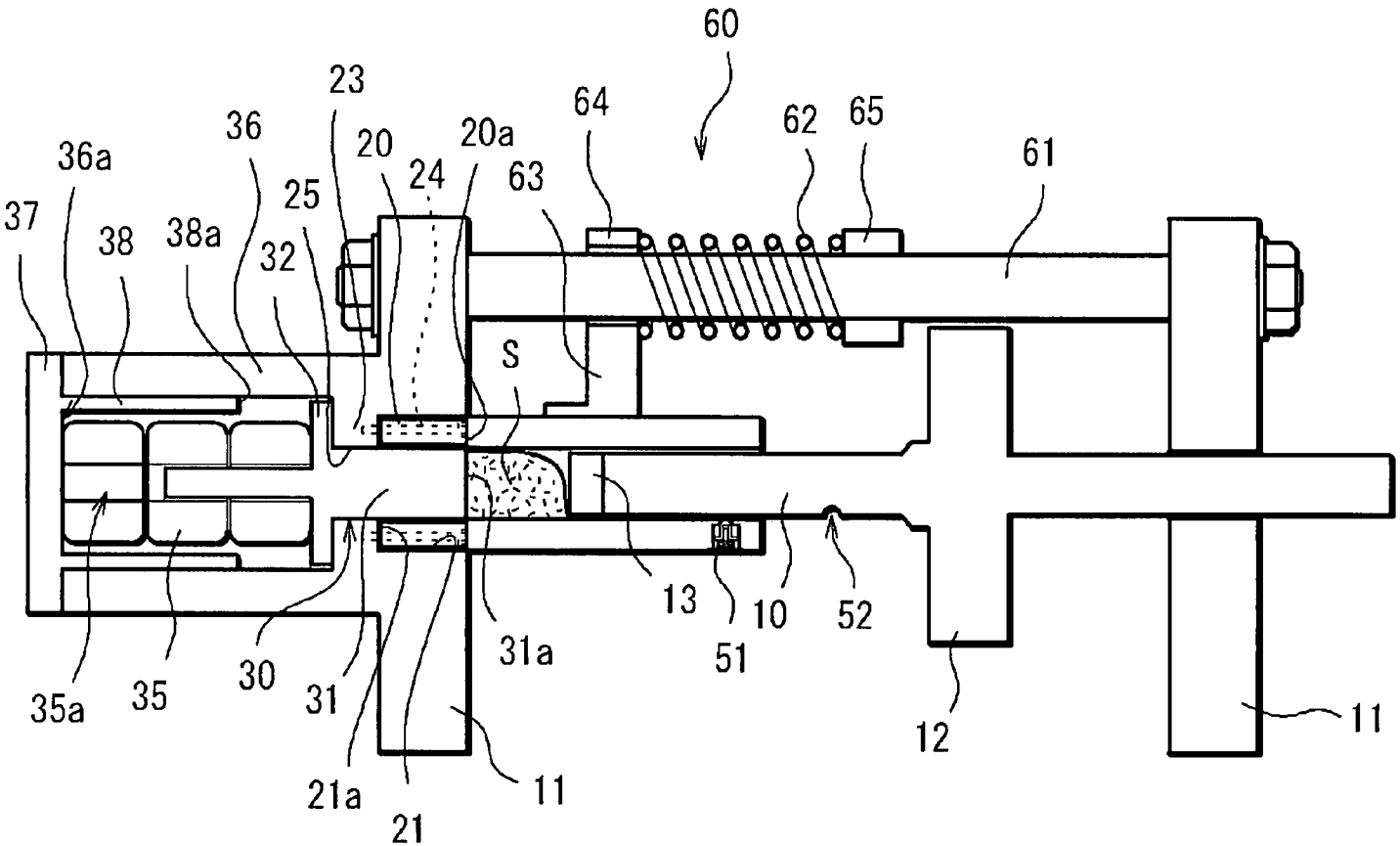
FIG. 6 is a diagram explaining the operation of the briquette manufacturing apparatus shown in FIG. 1, showing a state where a pusher shaft is advanced to start a compacting step of the subject material.

The resilient member 35 is accommodated in a cylindrical casing 36 formed on an opposite side of the fixing plate 11 from its side opposing the pusher shaft 10. The cylindrical casing 36 is disposed in coaxial relation with the pusher shaft 10 and having its opening 36*a* closed with a cover 37. The cover 37 is fixed to an end surface of the casing 36 by means of a bolt 39. A cylindrical body 38 is projected from one side of the cover 37. The stopper 32 is designed to abut against an end surface 38*a* of the cylindrical body 38 thereby defining the farthest position of the cylindrical column portion 31 from the pusher shaft 10 (FIG. 6). In order to prevent the formation of burrs on the compressed/solidified briquette, an axial length of the cylindrical body 38 is defined such that end surface 31*a* of the cylindrical column portion 31 is shifted from a bottom 21*a* of the recess 21 toward the pusher shaft 10 when the cylindrical column portion 31 is farthest from the pusher shaft. Alternatively, the above cylindrical body 38 may be replaced by a ring body or a block body, which is fixed to a predetermined place on an inside surface of the casing 36 so as to define an end point of the movement of the ejector 30.

The resilient member 35 may employ any material that has great flexibility and exhibits a predetermined restorative force. Examples of the usable material include urethane, gas spring, disk spring and the like.

The embodiment employs three short cylinder bodies formed of urethane in the light of deformation of urethane. The short cylinder bodies are axially centrally formed with through holes 35*a*, through which the guide shaft 33 is inserted.

Figure 4:
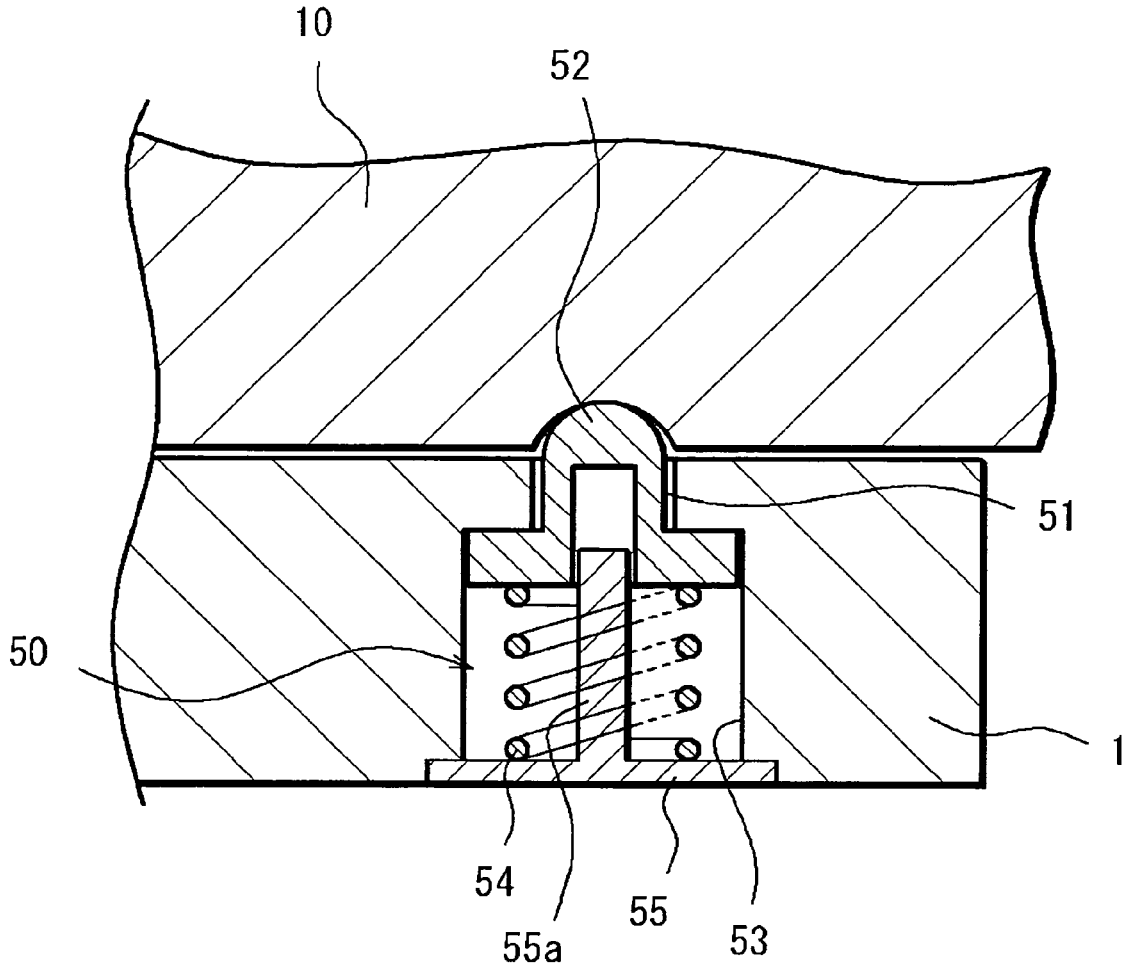
FIG. 4 is an enlarged view illustrating one example of engaging means in the invention.

The apparatus according to the embodiment employs engaging means 50 for bringing the pusher shaft 10 and the first cylinder body 1 into engagement when the first cylinder body 1 is spaced away from the second cylinder body 20 in order to discharge the compacted briquette B. The engaging means 50 permits the first cylinder body 1 to be moved along with the pusher shaft 10 when the pusher shaft 10 is retreated. As shown in FIG. 4, the engaging means 50 includes a projection 51 disposed at the first cylinder body 1 and adapted to project into the first cylinder body 1; and a recess 52 formed in an outer periphery of the pusher shaft 10 and has a size so as to allow at least a part of the projection 51 to be fitted therein. A distal end of the projection 51 is shaped like a semisphere, whereas the recess 52 has a dome-like inside surface so as to allow the distal end of the projection 51 to be fitted therein. The projection 51 is pushed in a direction to project into the first cylinder body 1 by means of a coil spring 54 disposed in a hole 53 formed in the wall of the first cylinder body 1. Indicated by numeral 55 is a cover for closing the above hole 53. The projecting motion of the projection 51 is guided by a guide shaft 55*a* upstanding from a back side of the cover 55.

The apparatus according to the embodiment further includes pushing means 60 for pushing the first cylinder body 1 toward the second cylinder body 20. As shown in FIG. 1 to FIG. 3, the pushing means 60 includes: a coil spring 63 coiled about a rod 61 disposed in parallel to an axis of the first cylinder body 1; and an arm 63 having one end thereof fixed to the first cylinder body 1 and the other end thereof slidably assembled to the rod 61. The coil spring 62 is coiled about a part of the rod 61, the part extending between a guide ring 64 formed at the other end of the arm 63 and a stopper 65 secured to the rod 61. The coil spring 62 pushes the first cylinder body 1 toward the second cylinder body 20. Accordingly, the first cylinder body 1 is in contact with the second cylinder body 20 when the projection 51 is not engaged with the recess 52. A bearing 66 is mounted to an inner periphery of the guide ring 64, allowing the arm 63 to be smoothly moved on the rod 61.

The provision of the engaging means 50 and the pushing means 60 permits the first cylinder body 1 to be moved away from the second cylinder body 20 in conjunction with the movement of the pusher shaft 10, and to be automatically returned an original position (where the first cylinder body 1 is in contact with the second cylinder body 20 and allows the feeding of the subject material S) after the briquette B is discharged. Therefore, the apparatus may have a simplified structure omitting a driving mechanism for the first cylinder body 1. This results in the cost reduction of the apparatus and a simplified maintenance work.

Next, a briquette manufacturing method using the aforementioned apparatus will be described with reference to FIG. 5 to FIG. 9.

Figure 5:
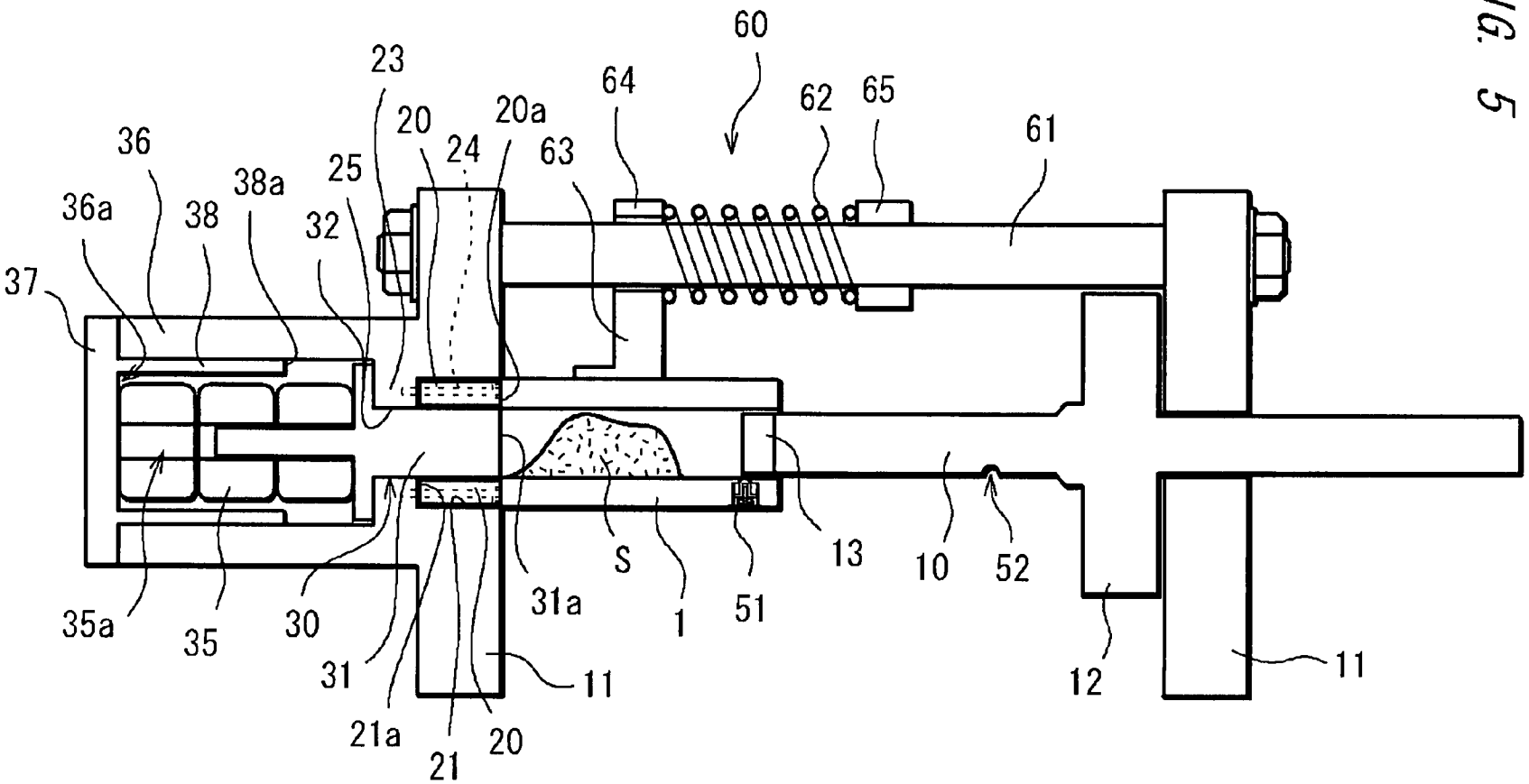
FIG. 5 is a diagram explaining an operation of the briquette manufacturing apparatus shown in FIG. 1, showing a state where a subject material is fed into a first cylinder body positioned at an original position.

FIG. 5 shows a state of the apparatus prior to the start of a compacting step. The pusher shaft 10 is at a rearmost position, whereas the first cylinder body 1 is held in contact with the second cylinder body 20 by means of the pushing means 60. In this state, a predetermined quantity of subject material S is fed into the first cylinder body 1 via the opening of the first cylinder body 1 by means of the screw conveyor.

Subsequently, the motor 44 of the ball screw mechanism 40 is actuated to rotate the ball screws 42. Thus is advanced the movable plate 12, so that the pusher shaft 10 fixed to the movable plate 12 starts to compress the subject material S (refer to FIG. 6).

Figure 7:
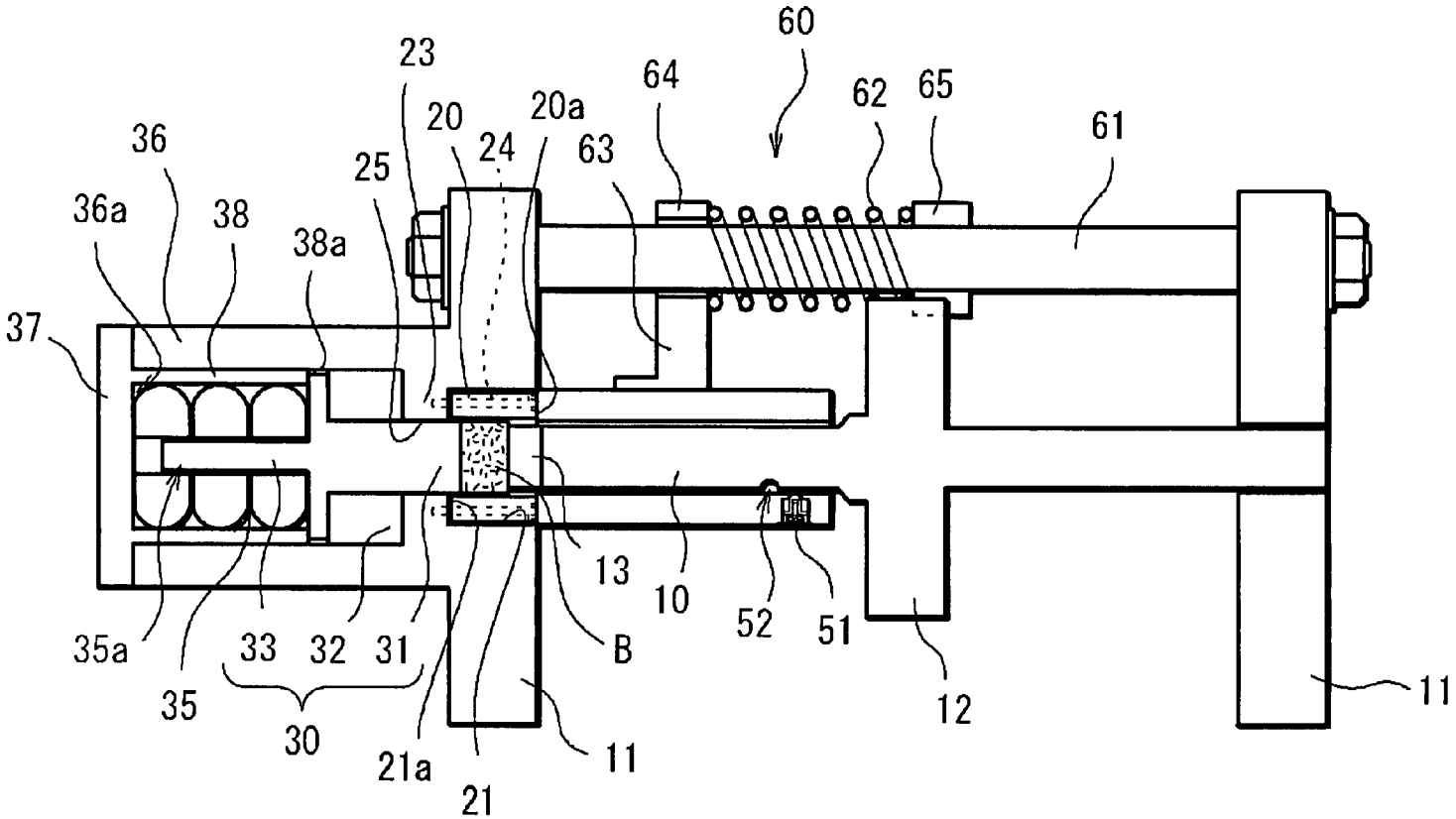
FIG. 7 is a diagram explaining the operation of the briquette manufacturing apparatus shown in FIG. 1, showing a state where a briquette is formed at completion of the compression of the subject material.

The motor 44 is further driven to continue the compression of the subject material S, while the chip 13 attached to the distal end of the first cylinder body 1 is moved beyond the first cylinder body 1 and slidably moved in the second cylinder body 20. In this process, the ejector 30 receives the pressing force from the pusher shaft 10 via the subject material S so as to be gradually moved (retreated) toward the opposite side (the left-hand side as seen in the figure) from the pusher shaft 10. Subsequently, the ejector 30 comes to rest when the stopper 32 of the ejector 30 abuts against the end surface 38*a* of the cylindrical body 38 of the cover 37. In this state, the position of the end surface 31*a* of the cylindrical column portion 31 is fixed, so that the subject material S can be solidified as pressed against the end surface 31*a*, a distal end surface 13*a* of the chip 13 and an inside surface of the second cylinder body 20 by briefly operating the motor. FIG. 7 shows a state where the compaction of the subject material is completed. At this time, the resilient member 35 is in the greatest flexure. While the pusher shaft 10 is moved from the position shown in FIG. 6 to the position shown in FIG. 7, the projection 51 is temporarily fitted in the recess 52. In the states shown in FIG. 6 to FIG. 7, however, the first cylinder body 1 is in contact with the second cylinder body 20 and hence, the engagement between the projection 51 and the recess 52 is cancelled by further advancing the pusher shaft 10.

Figure 8:
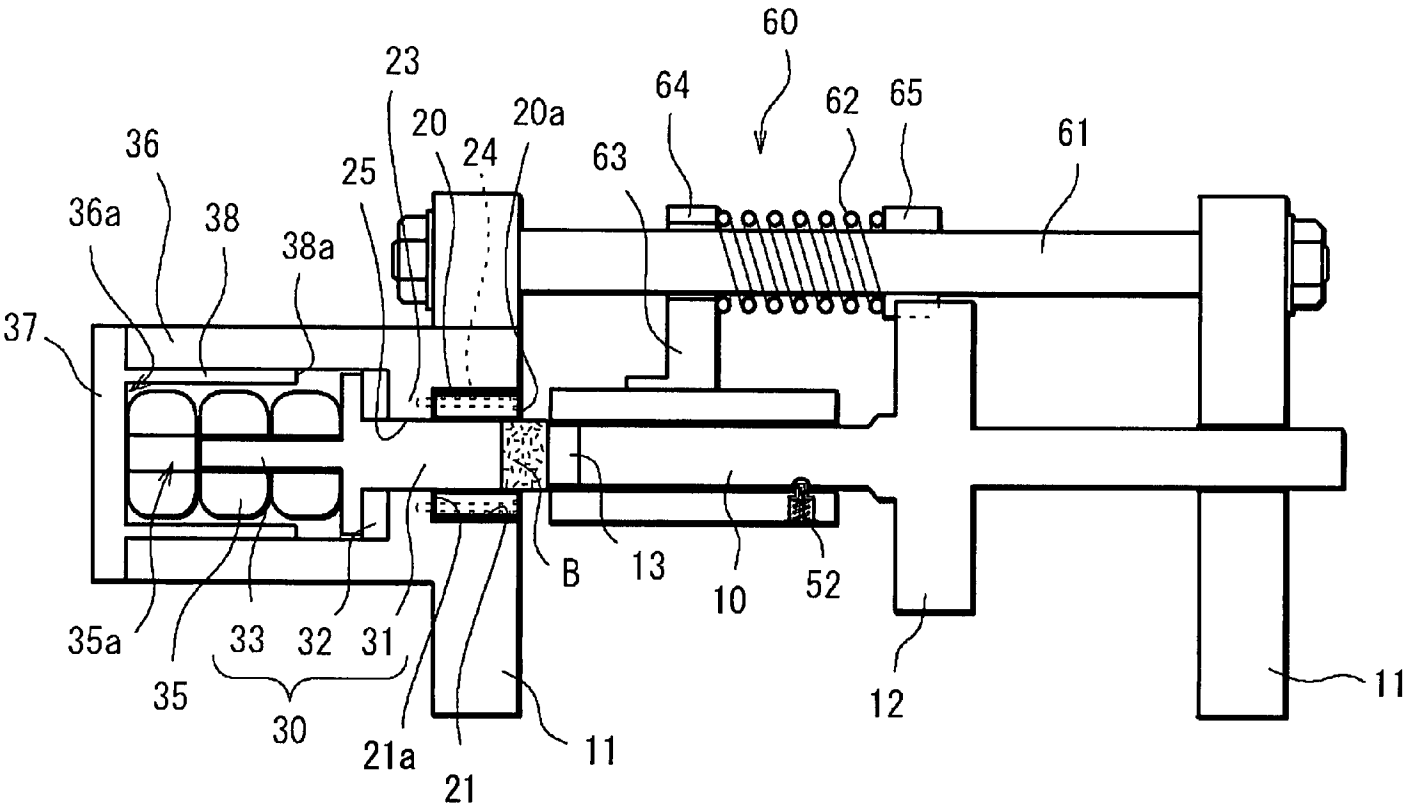
FIG. 8 is a diagram explaining the operation of the briquette manufacturing apparatus shown in FIG. 1, showing a state where the pusher shaft along with the first cylinder body are retreated while the briquette is pushed out by an ejector.

When the briquette B is formed at the completion of the compacting operation, the pusher shaft 10 is retreated by reversing the rotation of the motor 44 (refer to FIG. 8). A minor retreat of the pusher shaft 10 (by a quantity substantially equivalent to the thickness of the chip 13 according to the illustration) brings the projection 51 into engagement with the recess 52 so that the first cylinder body 1 is capable of being moved axially in conjunction with the movement of the pusher shaft 10. Specifically, the projection 51 is fitted in the recess 52 thereby bringing the first cylinder body 1 into movement in a direction to be spaced away from the second cylinder body 20, whereby the gap is formed between the first cylinder body 1 and the second cylinder body 20. In addition, the retreat of the pusher shaft 10 releases the ejector 30 from the pressure applied from the pusher shaft 10. Hence, the ejector is moved toward the pusher shaft 10 (in the rightward direction as seen in FIG. 8) by the pushing force of the resilient member 35, thus progressively pushing the briquette B out of the second cylinder body 20.

Figure 9:
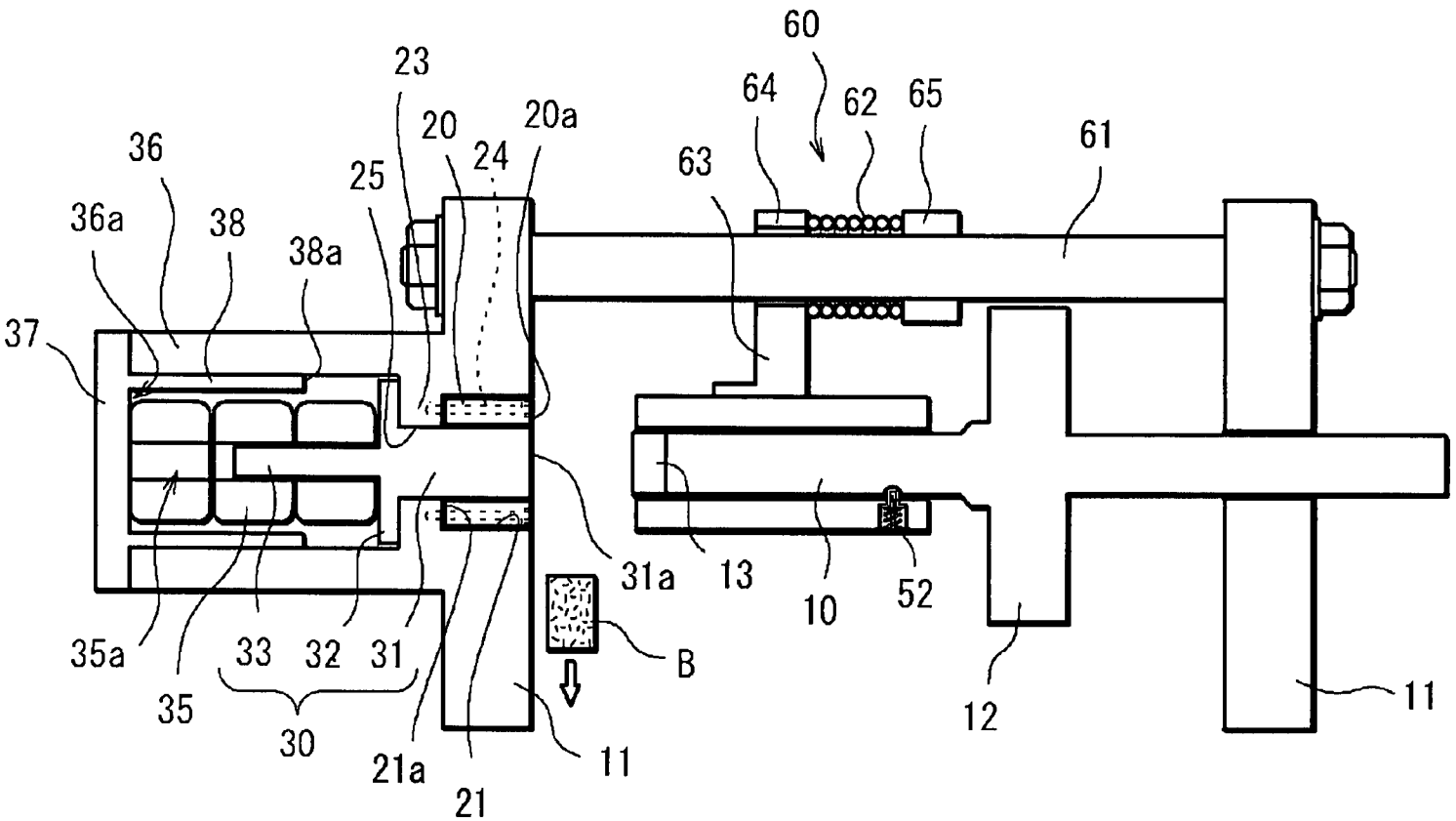
FIG. 9 is a diagram explaining the operation of the briquette manufacturing apparatus shown in FIG. 1, showing a state where the briquette is falling by gravity.

When the distal end of the pusher shaft 10 is spaced from the end surface 20*a* of the second cylinder body 20 by a distance greater than the thickness of the briquette B, as shown in FIG. 9, the briquette B falls down by gravity through the gap between first cylinder body 1 and the second cylinder body 20 and is received by a casing (not shown) disposed at a lower part of the apparatus. On the other hand, the first cylinder body 1 is moved along with the pusher shaft 10 for some distance as guided by the rod 61. However, when the coil spring 62 is flexed to a limit or when a repulsive force of the coil spring 62 exceeds a force of engagement between the projection 51 and the recess 52, the above engagement is cancelled so that the pushing force of the coil spring 62 moves the first cylinder body 1 to the position to contact against the second cylinder body 20. When the pusher shaft 10 is returned to an original position, the motor 44 is deactivated to complete one cycle of the compacting operation. Subsequently, the briquettes B are sequentially manufactured by repeating the aforementioned operations.

Next, an apparatus according to another embodiment of the invention will be described.

Figure 10:
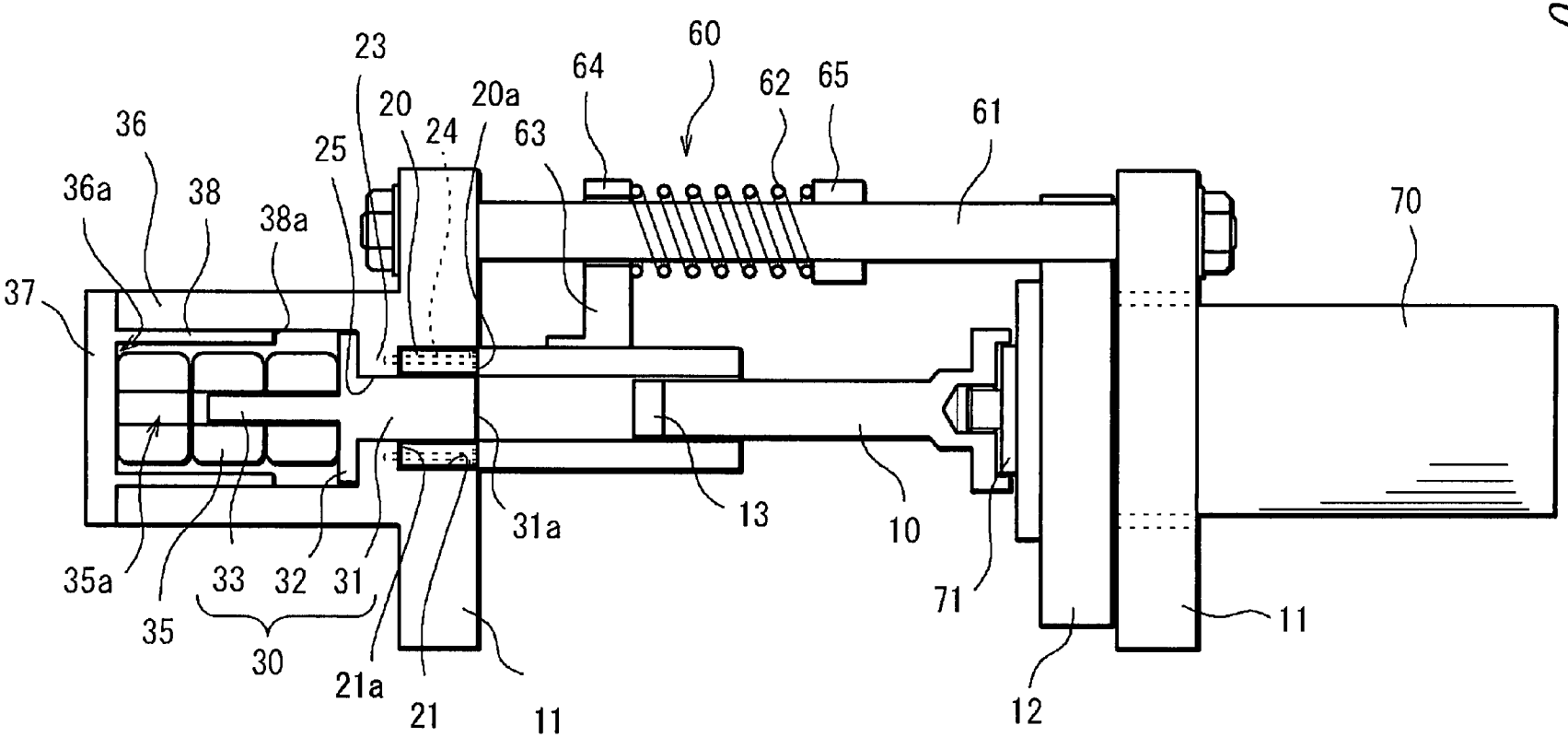
FIG. 10 is a side view illustrating a briquette manufacturing apparatus according to another embodiment of the invention.
Figure 11:
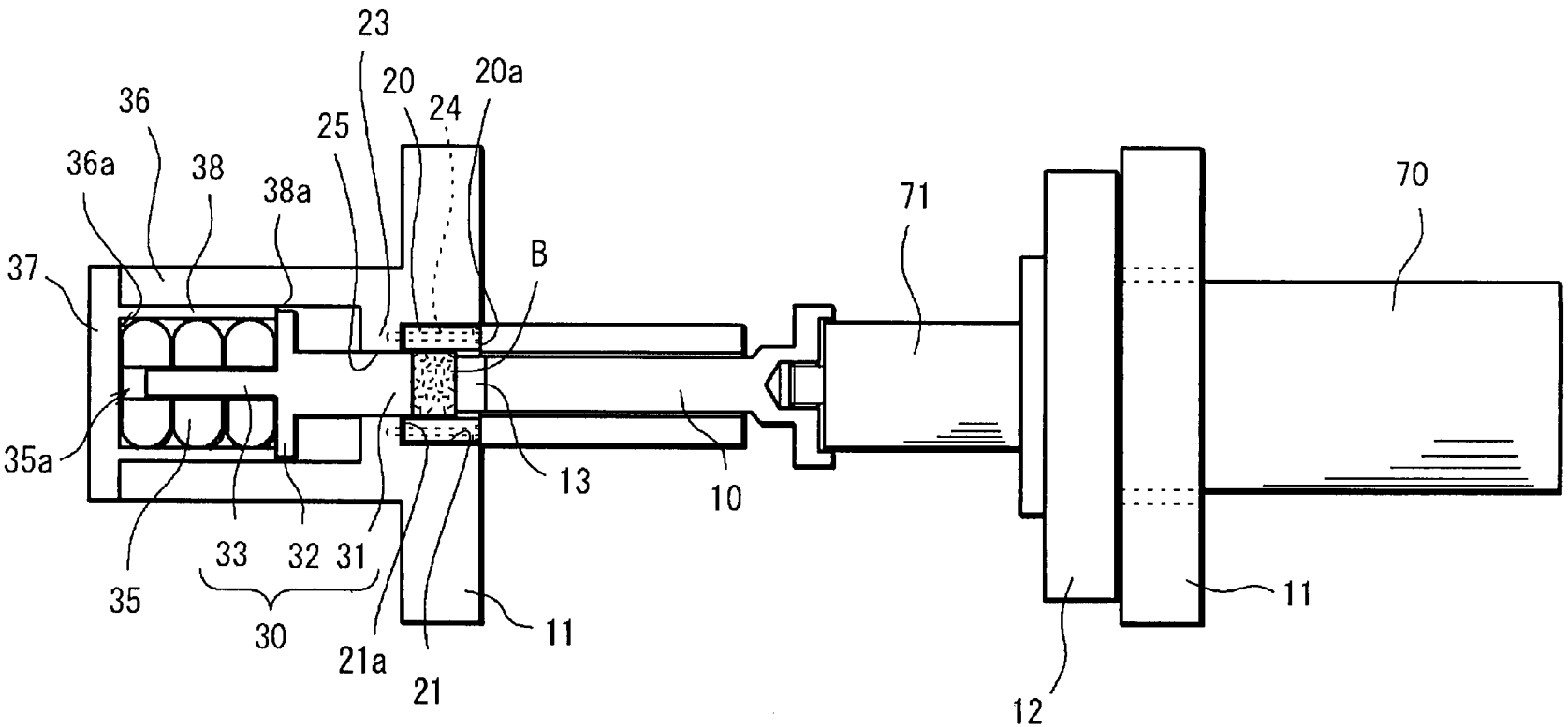
FIG. 11 is a plan view illustrating the briquette manufacturing apparatus according to the above embodiment of the invention.

FIG. 10 and FIG. 11 are a side view and a plan view, respectively, illustrating the apparatus according to the other embodiment of the invention. This embodiment differs from the embodiment shown in FIG. 1 to FIG. 9 in that the ball screw mechanism as the driving means is replaced by a hydraulic cylinder 70. The other components are substantially the same and hence, the description thereof is dispensed with.

According to the embodiment, the pusher shaft 10 is formed with a female thread portion at one end thereof (opposite to an end thereof, which is assembled with the chip 13). The female thread portion is threadedly engaged with a male thread portion projected from a distal end of a rod 71 of the hydraulic cylinder 70, whereby the pusher shaft 10 if fixed to the rod 70.

The apparatus according to this embodiment is also adapted to manufacture the briquette B the same way as the apparatus shown in FIG. 1 to FIG. 9.

While the foregoing embodiments employ the resilient member such as urethane or disk spring as the pushing mechanism, the invention is not limited to this. Specifically, a constitution may also be made wherein an actuator such as a hydraulic cylinder is used as the pushing mechanism, and wherein a rod of the actuator is coupled with the ejector and is extended toward the pusher shaft for discharging the briquette. Alternatively, a cam mechanism may be used for reciprocally moving the ejector in conjunction with the motion of the pusher shaft.

Otherwise, the ejector and the pushing mechanism may be dispensed with, and the pressure receiving member may be moved toward the first cylinder body by means of a suitable actuator at the completion of the compacting operation, thereby discharging the briquette.

According to the foregoing embodiments, the two cylinder bodies (the first cylinder body and the second cylinder body) constitute the compaction chamber. It is also possible to use one or more than one additional cylinder bodies. The invention does not exclude such cases. That is, the requirement of the briquette manufacturing apparatus of the invention is to include at least two cylinder bodies which are arranged in coaxial and tandem relation and are allowed to move relative to each other.

The pressure receiving member may have the whole body thereof disposed in the second cylinder body as illustrated by the embodiments hereof, or may have a part thereof disposed in the second cylinder body.

The invention claimed is:

1. A briquette manufacturing apparatus comprising: a first cylinder body constituting a compaction chamber for compacting a subject material and is formed with an opening through which the subject material is supplied; a pusher shaft slidably disposed in the first cylinder body and serving to compress and solidify the subject material; driving means for driving the pusher shaft; a second cylinder body disposed in coaxial and tandem relation with the first cylinder body; and a pressure receiving member disposed in the second cylinder body and having a pressure receiving surface opposing a distal end surface of the pusher shaft, wherein the first cylinder body and the second cylinder body are allowed to move relative to each other in an axial direction.

2. The briquette manufacturing apparatus according to claim 1, wherein the pressure receiving member comprises an ejector slidably disposed in the second cylinder body and allowed to retreat during a compacting operation of the subject material, and wherein the briquette manufacturing apparatus further comprises a pushing mechanism for pushing the ejector toward the pusher shaft.

3. The briquette manufacturing apparatus according to claim 2, wherein the pushing mechanism comprises a resilient member disposed on an opposite side of the ejector from its side opposing the pusher shaft and serving to push the ejector toward the pusher shaft.

4. The briquette manufacturing apparatus according to claim 1, further comprising engaging means for bringing the pusher shaft and the first cylinder body into engagement.

5. The briquette manufacturing apparatus according to claim 4, wherein the engaging means comprises: a projection formed at the first cylinder body to project into the first cylinder body; and a recess formed in an outer periphery of the pusher shaft and having a size to allow at least a part of the projection to be fitted.

6. The briquette manufacturing apparatus according to claim 1, further comprising pushing means for pushing the first cylinder body toward the second cylinder body.

7. The briquette manufacturing apparatus according to claim 6, wherein the biasing means comprises: a coil spring coiled about a rod extended in parallel to an axis of the first cylinder body; and an arm having one end thereof fixed to the first cylinder body and the other end thereof slidably mounted to the rod.

8. The briquette manufacturing apparatus according to claim 1, wherein the driving means comprises a ball screw mechanism for drivably moving the pusher shaft back and forth as converting a rotational motion of a motor into a linear motion.

9. The briquette manufacturing apparatus according to claim 2, further comprising engaging means for bringing the pusher shaft and the first cylinder body into engagement.

10. The briquette manufacturing apparatus according to claim 3, further comprising engaging means for bringing the pusher shaft and the first cylinder body into engagement.

11. The briquette manufacturing apparatus according to claim 2, further comprising pushing means for pushing the first cylinder body toward the second cylinder body.

12. The briquette manufacturing apparatus according to claim 3, further comprising pushing means for pushing the first cylinder body toward the second cylinder body.

13. The briquette manufacturing apparatus according to claim 4, further comprising pushing means for pushing the first cylinder body toward the second cylinder body.

14. The briquette manufacturing apparatus according to claim 5, further comprising pushing means for pushing the first cylinder body toward the second cylinder body.

15. The briquette manufacturing apparatus according to claim 2, wherein the driving means comprises a ball screw mechanism for drivably moving the pusher shaft back and forth as converting a rotational motion of a motor into a linear motion.

16. The briquette manufacturing apparatus according to claim 3, wherein the driving means comprises a ball screw mechanism for drivably moving the pusher shaft back and forth as converting a rotational motion of a motor into a linear motion.

17. The briquette manufacturing apparatus according to claim 4, wherein the driving means comprises a ball screw mechanism for drivably moving the pusher shaft back and forth as converting a rotational motion of a motor into a linear motion.

18. The briquette manufacturing apparatus according to claim 5, wherein the driving means comprises a ball screw mechanism for drivably moving the pusher shaft back and forth as converting a rotational motion of a motor into a linear motion.

19. The briquette manufacturing apparatus according to claim 6, wherein the driving means comprises a ball screw mechanism for drivably moving the pusher shaft back and forth as converting a rotational motion of a motor into a linear motion.

20. The briquette manufacturing apparatus according to claim 7, wherein the driving means comprises a ball screw mechanism for drivably moving the pusher shaft back and forth as converting a rotational motion of a motor into a linear motion.

* * * * *